United States Patent [19]

Ikeda et al.

[11] Patent Number: 4,593,298

[45] Date of Patent: Jun. 3, 1986

[54] HEAT-SENSITIVE RECORDING PAPER

[75] Inventors: Kenji Ikeda; Takayuki Hayashi; Kensuke Ikeda; Hiroharu Matsukawa, all of Shizuoka, Japan

[73] Assignee: Fuji Photo Film Co., Ltd., Kanagawa, Japan

[21] Appl. No.: 771,077

[22] Filed: Aug. 30, 1985

[30] Foreign Application Priority Data

Aug. 30, 1984 [JP] Japan ..... 59-180916
Dec. 11, 1984 [JP] Japan ..... 59-261405

[51] Int. Cl.[4] ..... B41M 5/18

[52] U.S. Cl. ..... 346/200; 346/226; 427/150; 427/152

[58] Field of Search ..... 346/200, 226; 427/150, 427/151, 152; 428/207, 341, 342, 913, 914, 500, 511

[56] References Cited

U.S. PATENT DOCUMENTS

| | | | |
|---|---|---|---|
| 4,370,370 | 1/1983 | Iwata et al. | 428/913 |
| 4,388,362 | 6/1983 | Iwata et al. | 427/152 |
| 4,424,245 | 1/1984 | Maruta et al. | 428/914 |

*Primary Examiner*—Bruce H. Hess
*Attorney, Agent, or Firm*—Sughrue, Mion, Zinn, Macpeak and Seas

[57] ABSTRACT

A heat-sensitive recording paper is described, comprising a support having formed thereon a heat-sensitive recording layer containing a colorless or pale-colored electron donating dye precursor and an electron accepting substance that reacts with said electron donating dye precursor to develop color, and an overlying protective layer containing a water-soluble polymeric binder and a pigment, wherein the back side of the support is provided with a backcoat layer containing an alkali salt of a styrene-maleic acid copolymer.

20 Claims, No Drawings

HEAT-SENSITIVE RECORDING PAPER

FIELD OF THE INVENTION

The present invention relates to a heat-sensitive recording paper, and more particularly, to a heat-sensitive recording paper containing colorless or pale-colored electron donating dye and an electron accepting substance that reacts with said electron donating dye precursor to develop color.

BACKGROUND OF THE INVENTION

Descriptions of heat-sensitive recording paper that produces a recorded image by thermal reaction between an electron donating colorless dye precursor (hereinafter referred to as a color former) and an electron accepting substance (hereinafter referred to as color developer) are set forth in Japanese Patent Publication Nos. 14039/1970 and 4160/1968. The use of heat-sensitive recording paper has expanded to terminal printers connected to electronic computers and instrumentation equipment of various types, as well as to facsimile recording apparatus.

When heat-sensitive recording paper is brought into contact with chemicals or oil, the recorded image may either lose its color or develop fog. These problems are serious and must be solved in order that heat-sensitive recording paper may gain wide commercial acceptance.

In order to meet this requirement, a protective layer is conventionally formed on the heat-sensitive recording layer, as is described in Japanese Patent Application (OPI) Nos. 30347/1973, 31958/1973, 19840/1978, 14751/1979, 53545/1979, 111837/1979, 128349/1979, 126193/1981, 139993/1981, 10530/1982, 29491/1982, 105392/1982, 107884/1982, 53484/1983, and 193189/1983 (The term "OPI" as used herein referes to a "published unexamined Japanese Patent Application"). The commercial value of the heat-sensitive recording paper having such protective layer can be increased by providing the back side of the support with a backcoat layer containing a water-soluble polymeric binder and an inorganic pigment because this backcoat layer not only improves the running properties of the recording paper but also prevents the occurrence of sheet curling and imparts chemical resistance to the back side of the support.

However, because of the water-soluble polymeric binder it contains, the conventional backcoat layer has low water resistance and swells in a moist atmosphere, sticking to the protective layer on an underlying sheet of heat-sensitive recording paper (this sticking phenomenon is also referred to as blocking). Therefore, the commercial value thereof is inferior. In order to prevent the occurrence of blocking, which leads to unsalable products, the use of an alkali salt of isobutylene-maleic anhydride copolymer has been described Japanese Patent Application (OPI) No. 9091/1984, but the water resistance of the backcoat layer containing such alkali salt is still unsatisfactory.

SUMMARY OF THE INVENTION

A principal object, therefore, of the present invention is to provide a heat-sensitive recording paper that is free from the defects of the conventional backcoat layer (i.e., has high water resistance and reduced tendency toward blocking), while exhibiting improved running properties and increased resistance to sheet curling.

The heat-sensitive recording paper in accordance with the present invention comprises a support having formed thereon a heat-sensitive recording layer containing a colorless or pale-colored electron donating dye precursor and an electron accepting substance that reacts with said electron donating dye precursor to develop color, and an overlying protective layer containing a water-soluble polymeric binder and a pigment, wherein the back side of the support is provided with a backcoat layer containing an alkali salt of a styrene-maleic acid copolymer.

According to a preferred embodiment, the back side of the support is provided with a backcoat layer containing an alkali salt of a styrene-maleic acid copolymer and a polymeric latex.

The backcoat layer in accordance with the present invention is formed by applying an alkali salt of a styrene-maleic acid copolymer onto the back side of the support.

DETAILED DESCRIPTION OF THE INVENTION

Examples of the alkali salt of styrene-maleic acid copolymer from which the backcoat layer is made include sodium and ammonium salts of styrene-maleic acid copolymer, with the ammonium salt being preferred.

The alkali salts of styrene-maleic acid copolymer preferably have a degree of polymerization ranging from 500 to 5,000, with the range of from 1,500 to 2,500 being particularly preferred. The preferred molar ratio of the styrene-maleic acid in the copolymer is about 1:1.

Part of the alkali salt may be esterified and the preferred degree of esterification is in the range of from 35 to 50% Illustrative polymeric latexes that can be used in the backcoat layer in accordance with the present invention include styrene-butadiene copolymer latex, carboxy-modified styrene-butadiene copolymer latex, styrene-butadiene-vinyl pyridine terpolymer latex, acrylate ester copolymer latex, modified acrylate ester copolymer latex, styrene copolymer latex, vinyl acetate copolymer latex, vinyl acetate-acrylic acid copolymer latex, vinyl acetate-ethylene copolymer latex, acrylic acid-butadiene copolymer latex, and acrylic acid-styrene-butadiene terpolymer latex. Preferred polymeric latexes are styrene-butadiene copolymer latex and modified acrylate ester copolymer latex.

The polymer latex is preferably mixed with the alkali salt of styrene-maleic acid copolymer in such an quantity that the amount of the alkali salt of styrene-maleic acid copolymer ranges from 1.0 to 1,000 wt %, and more preferably from 10 to 100 wt %, based on the weight of the polymeric latex.

Pigments are preferably contained in the backcoat layer of the heat-sensitive recording paper in accordance with the present invention. Preferred pigments are inorganics such as zinc oxide, calcium carbonate, barium sulfate, titanium oxide, crystalline silica, amorphous silica lithopone, talc, pyrophyllite, kaolin, baked kaolin and aluminum hydroxide, and organics such as urea-formaldehyde resins and polyethylene.

The backcoat layer is generally applied in an amount ranging from 0.2 to 5.0 g/m$^2$, and preferably from 0.2 to 3.0 g/m$^2$, in terms of dry weight. The alkali salt of styrene-maleic acid copolymer is present in the backcoat layer in an amount that ranges from 10 to 200 wt %, and preferably from 25 to 75 wt %, based on the weight of the pigment. In order to ensure smooth running through actual recording apparatus, the surface of the backcoat layer is preferably finished to have a smoothness in the range of from 30 to 500 seconds, as measured by the method specified in JIS P 8119, with the range of from 80 to 150 seconds being particularly preferred.

In order to produce a coating solution for the backcoat layer that remains stable after the respective components have been dispersed, and for the purpose of removing any bubbles formed in the coating solution, a surfactant may be incorporated in the solution.

The heat-sensitive color forming layer in accordance with the present invention is formed by applying a coating solution onto a paper or synthetic resin film base. The coating solution coatins as essential components any of the color formers (leuco dyes) and color developers commonly used in the art, and optional components such as heat-fusible materials, organic or inorganic pigments and binders.

The color former and developer are individually dispersed in a water-soluble polymer (binder) by a suitable means such as a ball mill. The ether compound in accordance with the present invention is dispersed either in a similar manner, or dispersed simultaneously with the color former or developer in the form of a mixture therewith. The color former, color developer, and other compounds are dispersed until the volume average size of the individual particles becomes 5 μm or smaller, and preferably 2 μm or smaller. The resulting dispersions of the three materials are then combined together to form a coating solution for the heat-sensitive recording layer.

Examples of the color formers that can be used in the present invention include triarylmethane compounds, diphenylmethane compounds, xanthene compounds, thiazine compounds and spiropyran compounds. Several examples of each compound are listed below. First, illustrative triarylmethane compounds include 3,3-bis(p-dimethylaminophenyl)-6-dimethylaminophthalide (i.e., Crystal Violet Lactone), 3,3-bis(p-dimethylaminophenyl)phthalide, 3-(p-dimethylaminophenyl)-3-(1,3-dimethylindol-3-yl)phthalide, and 3-(p-dimethylaminophenyl)-3-(2-methylindol-3-yl)phthalide. Exemplary diphenylmethane compounds include 4,4'-bis-dimethylaminobenzhydrin benzyl ether, N-halophenyl-leuco Auramine, and N-2,4,5-trichlorophenyl leuco Auramine. Examples of the xanthene compounds include the following: Rhodamine (p-nitroanilino)lactam, Rhodamine B (p-chloroanilino)lactam, 2-dibenzylamino-6-diethylaminofluoran, 2-anilino-6-diethylaminofluoran, 2-anilino-3-methyl-6-diethylaminofluoran, 2-aniliono-3-methyl-6-N-cyclohexyl-N-methylaminofluoran, 2-anilino-3-methyl-6-N-ethyl-N-isoamylaminofluoran, 2-o-chloroanilino-6-diethyl-aminofluoran, 2-m-chloroanilino-6-diethylaminofluoran, 2-(3,4-dichloroanilino)-6-diethylaminofluoran, 2-octylamino-6-diethylaminofluoran, 2-dihexylamino-6-diethylaminofluoran, 2-m-trichloromethylanilino-6-diethylaminofluoran, 2-butylamino-3-chloro-6-diethylaminofluoran, 2-ethoxyethylamino-β-chloro-6-diethylaminofluoran, 2-anilino-3-chloro-6-diethylaminofluoran, 2-diphenylamino-6-diethylaminofluoran, 2-anilino-3-methyl-6-diphenylaminofluoran, 2-anilino-3-methyl-5-chloro-6-diethylaminofluoran, 2-anilino-3-methyl-6-diethylamino-7-methylfluoran, 2-anilino-3-methoxy-6-dibutylaminofluoran, 2-o-chloroanilino-6-dibutylaminofluoran, 2-p-chloroanilino-3-ethoxy-6-diethylaminofluoran, 2-phenyl-6-diethylaminofluoran, 2-o-chloroanilino-6-p-butylanilinofluoran, 2-anilino-3-pentadecyl-6-diethylaminofluoran, 2-nilino-3-ethyl-6-dibutylaminofluoran, 2-anilino-3-ethyl-6-N-ethyl-N-isoamylaminofluoran, 2-anilino-3-methyl-6-N-ethyl-N-γ-methoxypropylaminofluoran, 2-anilino-3-phenyl-6-diethylaminofluoran, 2-diethylamino-3-phenyl-6-diethylaminofluoran, and 2-anilino-3-methyl-6-N-isoamyl-N-ethylaminofluoran. Illustrative thiazine compounds include benzoyl leuco Methylene Blue and p-nitrobenzyl leuco Methylene Blue. Exemplary spiropyran compounds include 3-methyl-spiro-dinaphthaopyran, 3-ethyl-spiro-dinaphthopyran, 3,3'-dichloro-spirodinaphthopyran, 3-benzyl-spiro-dinaphthopyran, 3-methyl-naphtho-(3-methoxybenzo)-spiropyran and 3-propyl-spirodibenzopyran. These color formers may be used either alone or in combination.

Examples of the color developers that can be used in the present invention include bisphenols such as 2,2-bis(4'-hydroxyphenyl)-propane (bisphenol A), 2,2-bis(4-hydroxyphenyl)pentane, 2,2-bis(4'-hydroxy-3',5'-dichlorophenyl)propane, 1,1-bis(4'-hydroxyphenyl)cyclohexane, 2,2-bis(4'-hydroxyphenyl)hexane, 1,1-bis(4'-hydroxyphenyl)propane, 1,1-bis(4'-hydroxyphenyl)butane, 1,1-bis(4'-hydroxyphenyl)pentane, 1,1-bis(4'-hydroxyphenyl)hexane, 1,1-bis(4'-hydroxyphenyl)heptane, 1,1-bis(4'-hydroxyphenyl) octane, 1,1-bis(4'-hydroxyphenyl)-2-methylpentane, 1,1-bis(4-hydroxyphenyl)-3-ethylhexane, and 1,1-bis(4'-hydroxyphenyl)-dodecane; salicylic acids such as 3,5-di-α-methylbenzylsalicylic acid, 3,5-di-tertiary butyl salicylic acid and 3-α,α-dimethylbenzylsalicylic acid, as well as polyvalent metal salts thereof, with zinc and aluminum salts being particularly preferred; oxybenzoic acid esters such as benzyl p-hydroxybenzoate, and 2-ethylhexyl p-hydroxybenzoate; and phenols such as p-phenylphenol, 3,5-diphenylphenol, and cumylphenol.

Bisphenols are particularly preferred color developers.

The binder is selected from among the compounds that have water solubilities (at 25° C.) of not less than 5 wt %, and specific examples of the binder include methyl cellulose, carboxymethyl cellulose, hydroxyethyl cellulose, starches, gelatin, gum arabic, casein, polyacrylamide, styrene-maleic anhydride copolymer hydrolyzate, ethylenemaleic anhydride copolymer hydrolyzate, isobutylene-maleic anhydride copolymer hydrolyzate, polyvinyl alcohol, and carboxy-modified polyvinyl alcohol.

Suitable oil-absorbing pigments that can be used in the present invention include inorganic pigments such as zinc oxide, calcium carbonate, barium sulfate, titanium oxide, lithopone, talc, pyrophyllite, kaolin, aluminum hydroxide baked kaolin, crystalline silica and amorphous silica, as well as organic pigments such as urea-formaldehyde resins and polyethylene powder.

Metal salts of higher aliphatic acids may be used in the present invention as metal soaps, and examples include zinc stearate, calcium stearate, and aluminum stearate.

Waxes may also be used, such as polyethylene wax, carnauba wax, paraffin wax, microcrystalline wax and aliphatic acid amides.

The heat-sensitive recording layer in accordance with the present invention may further contain an antioxidant, UV absorber, or other agents to improve the image keeping quality. Examples of the last-mentioned agents include phenols having an alkyl substituent on at least one of the 2- and 6-positions, and derivatives of such phenols. Preferred are phenols having a branched chain alkyl substituent on at least one of 2- and 6-positions, and derivatives thereof. Also preferred are those having a plurality of phenolic groups in the molecule, and those having 2 or 3 phenolic groups in the molecule are particularly preferred.

The coating solution for the heat-sensitive recording layer is applied to a support such as neutralized paper, fine paper or a plastic film, and subsequently dried. All the components of the solution may be first mixed together simultaneously and the mixture ground into sufficiently small particles to form a dispersion. Alternatively, the components can be divided into suitable groups, which are separately ground, dispersed, and mixed together.

The heat-sensitive color forming layer thus prepared is then provided with a protective layer in accordance with the present invention by application of a coating solution cotaining a water-soluble polymeric binder and an inorganic or organic pigment.

Suitable examples of the water-soluble polymeric binder include polyvinyl alcohol, methyl cellulose, starch, carboxymethyl cellulose, styrene-maleic acid copolymer, diisobutylene-maleic acid copolymer, polyamide resin, polyacrylamide resin, and the like.

Illustrative pigments that can be used include inorganics such as zinc oxide, calcium carbonate, barium sulfate, titanium oxide, lithopone, talc, pyrophyllite, kaolin, baked kaolin, crystalline silica, amorphous silica, and aluminum hydroxide, as well as organics such as urea-formaldehyde resins and polyethylene powder.

The protective layer is applied in an amount ranging from 0.2 to 5.0 g/m$^2$, and preferably from 0.5 to 3.0 g/m$^2$, in terms of dry weight. As the coating amount is reduced, the heat-sensitive recording paper produced tends to have a decreased resistance to chemicals. On the other hand, as the coating amount of the protective layer is increased, the heat response of the heat-sensitive color forming layer tends to be impaired. In view of this trade-off relationship between chemical resistance and heat response, the coating amount of the protective layer should be determined in accordance with the relative importance of the two factors in a particular use.

The following Examples are provided for further illustration of the present invention, and are not to be construed as limiting. In the Examples, all parts and percentages are by weight, unless otherwise indicated.

EXAMPLE 1

Preparation of coating solution for heat-sensitive recording layer

Ten grams of a color former, 2-anilino-3methyl-6-N-cyclohexyl-N-methylaminofluoran, was dispersed in 25 g of a 10% aqueous solution of polyvinyl alcohol (98% saponification; degree of polymerization of 1,000) and 25 g of water in a ball mill for 24 hours to make Dispersion A. In a similar manner, 10 g of benzyl p-oxybenzoate, 5 g of 2,2'-methylene-bis(4-methyl-6-tert-butylphenol) and 15 g of calcium carbonate (Brilliant 15, product of Shiraishi Kogyo K.K.) were dispersed in 25 g of a 10% aqueous solution of polyvinyl alcohol (98% saponification; degree of polymerization of 1,000) and 50 g of water in a ball mill for 24 hours to make Dispersion B.

Dispersion A was mixed with Dispersion B in a weight ratio of 1/3. To 200 g of the mixture, 15 g of a 21% dispersion of zinc stearate was added and uniformly agitated to make a coating solution for a heat-sensitive recording layer.

The coating solution was applied onto base paper (basis weight: 47 g/m$^2$) in a thickness corresponding to a dry weight of 5 g/m$^2$. The web was dried at 60° C. for 1 minute to prepare a heat-sensitive recording layer on the paper base.

Onto this heat-sensitive recording layer was applied a coating solution (formulation below) for the topcoat layer to give a coating thickness corresponding to a dry weight of 2.5 g/m$^2$. The web was dried at 50° C. for 2 minutes and calendered to provide heat-sensitive recording paper having a surface smoothness of 850 seconds as determined by the method specified in JIS P 8119.

The coating solution for the topcoat layer was prepared as follows. A hundred grams of 10% polyvinyl alcohol, 25 g of 40% kaolin (Kaobrite, product of Georgia Pacific Co., Ltd.) and 40 g of water were intimately mixed to form a kaolin dispersion.

A coating solution for the backcoat layer having the formulation indicated below was applied to the back side of the heat-sensitive recording paper to provide a coating thickness of 2.5 g/m$^2$ in terms of dry weight. The web was dried at 50° C. for 2 minutes to provide a heat-sensitive recording paper with a backcoat layer in accordance with the present invention.

The coating solution for the backcoat layer was prepared as follows. Fifteen grams of an ammonium salt of 25% (aqueous solution) styrene-maleic anhydride copolymer (Polymaron 385, product of Arakawa Kagaku K.K.; degree of polymerization of 2,000) and 12.5 g of 50% calcium carbonate (Brilliant 15, product of Shiraishi Kogyo K.K.) dispersion were dispersed in 12.5 g of water.

EXAMPLE 2

Another sample of heat-sensitive recording paper was prepared as in Example 1, except that the backcoat layer was formed by application of a coating solution having 15 g of a sodium salt of 25% styrene-maleic acid copolymer (Scripset, product of Monsanto Company) and 12.5 g 50% calcium carbonate dispersed in 12.5 g of water.

EXAMPLE 3

A sample of heat-sensitive recording paper was prepared as in Example 1, except that the backcoat layer was formed by application of a coating solution having 15 g of a partially esterified ammonium salt of 25% styrene-maleic acid copolymer (SMA 1440, product of ARCO Chemical, Inc.) and 12.5 g of 50% calcium carbonate dispersed in 12.5 g of water.

EXAMPLE 4

Another sample of heat-sensitive recording paper was prepared as in Example 1, except that the backcoat layer was formed by application of a coating solution having the following components dispersed in 16.9 g of water: 5 grams of an ammonium salt of 25% styrene-maleic anhydride copolymer (Polymaron 385, product of Arakawa Kagaku K.K., degree of polymerization of 2,000), 5.6 g of a 45% styrene-butadiene copolymer latex (Nipol LX 855, product of Nippon Zeon Co., Ltd.), and 12.5 g of 50% calcium carbonate (Brilliant 15, product of Shiraishi Kogyo K.K.) dispersion.

EXAMPLE 5

Another sample of heat-sensitive recording paper was prepared as in Example 1, except that the backcoat layer was formed by application of a coating solution having the following components dispersed in 16.2 g of water: 5 g of an ammonium salt of 25% styrene-maleic anhydride copolymer, 6.3 g of 40% modified acrylate ester copolymer latex (Nipol 2507, product of Nippon Zeon Co., Ltd.) and 12.5 g of 50% calcium carbonate dispersion.

EXAMPLE 6

A sample of heat-sensitive recording paper was prepared as in Example 1, except that the backcoat layer was formed by application of a coating solution having the following components dispersed in 16.9 g of water: 5 g of an ammonium salt of 25% styrene-maleic anhydride copolymer, 5.6 g of 45% polystyrene latex (Nipol LX 303, product of Nippon Zeon Co., Ltd.) and 12.5 g of 50% calcium carbonate dispersion.

EXAMPLE 7

A sample of heat-sensitive recording paper was prepared as in Example 1, except that the backcoat layer was formed by application of coating solution having the following components dispersed in 16.2 g of water: 5 g of an ammonium salt of 25% styrene-maleic anhydride copolymer, 6.3 g of 40% styrene-butadiene copolymer latex (Nogatex SN 307, product of Sumitomo Chemical Co., Ltd.) and 12.5 g of 50% calcium carbonate dispersion.

COMPARATIVE EXAMPLE 1

A sample of heat-sensitive recording paper was prepared as in Example 1, except that the backcoat layer was formed from a coating solution having 30 g of 10% polyvinyl alcohol (product of Kuraray Co., Ltd.; 98% saponification; degree of polymerization of 1,000) and 10 g of 40% kaolin dispersion (Kaobrite, product of Shiraishi Kogyo K.K.) dispersed in 32.5 g of water.

COMPARATIVE EXAMPLE 2

A sample of heat-sensitive recording paper was prepared as in Example 1, except that the backcoat layer was formed from a coating solution having 15 g of ammonium salt of 25% diisobutylene-maleic acid copolymer (Isoban 04, product of Kuraray Co., Ltd.) and 12.5 g of 50% calcium carbonate dispersed in 12.5 g of water.

COMPARATIVE EXAMPLE 3

A sample of heat-senstive recording paper was prepared as in Example 1, except that the backcoat layer was formed from a coating solution having 10 g of 20% starch (MS-4600 of Nisshin Food Products Co.) and 6 g of 50% calcium carbonate dispersed in 17 g of water.

COMPARATIVE TESTS

The sheets of heat-sensitive recording paper prepared in Examples 1 to 7 and in Comparative Examples 1 to 3 were tested for their antiblocking properties, resistance to sheet curling, and running properties by the following methods.

(1) Antiblocking properties

A very small amount (0.5 μl) of water was dropped onto the surface of a recording sheet. A sheet of base paper was superimposed on the wet surface of the recording sheet and the assembly was dried with air for 1 hour. Thereafter, the paper was peeled off the recording sheet to see if any blocking occurred between the two sheets. The test results are shown in Table 1 by the three grade rating system, good, fair, and poor, wherein "good" indicates the absence of blocking.

(2) Reisstance to sheet curling

A recording sheet of international DIN size A4 (21×29.7 cm) was moisture-conditioned in a thermostat/humidistat chamber according to the following schedule: 30° C.×90% R.H.×1 hr, 25° C.×65% R.H.×1 hr and 20° C.×35% R.H.×1 hr. After the last conditioning mode, the height of the sheet was measured at the four corners and an average was taken for evaluation according to the following rating system:

| − ← | ± | → + |
|---|---|---|
| curl toward the backcoat layer | negligible curl | curl toward the heat-sensitive color forming layer |

(3) Running properties

The samples of heat-sensitive recording paper were set in a thermal receiver facsimile (Model UF-920 produced by Matsushita Graphic Communication Systems, Inc.) and characters were thermally printed on the samples in order to check for the occurrence of any sticking or adhesion to the platen rolls.

The results of each of the tests are shown in Table 1, from which one can see that the samples prepared according to the present invention were superior to the comparative samples in terms of resistance to sticking, blocking, and sheet curling.

TABLE 1

| Sample No. | Resistance to Sticking | Resistance to Blocking | Resistance to Sheet Curling |
|---|---|---|---|
| Example 1 | good | good | − |
| Example 2 | good | good | − |
| Example 3 | good | good | − |
| Example 4 | good | good | − |
| Example 5 | good | good | − |
| Example 6 | good | good | − |
| Example 7 | good | good | − |
| Comparative Example 1 | good | poor | ± |
| Comparative Example 2 | fair | poor | + |
| Comparative Example 3 | fair | poor | + |

In the heat-sensitive recording paper, it is preferred from viewpoint of the running and piling properties that the sheet curling tends toward the minus curl (−) to a certain extent in the above rating system.

While the invention has been described in detail and with reference to specific embodiments thereof, it will be apparent to one skilled in the art that various changes and modifications can be made therein without departing from the spirit and scope thereof.

What is claimed is:

1. A heat-sensitive recording paper comprising a support having formed thereon a heat-sensitive recording layer containing a colorless or pale-colored electron donating dye precursor and an electron accepting substance that reacts with said electron donating dye precursor to develop color, and an overlying protective layer containing a water-soluble polymeric binder and a pigment, wherein the back side of the support is provided with a backcoat layer containing an alkali salt of a styrene-maleic acid copolymer.

2. A heat-sensitive recording paper as in claim 1, wherein the back side of the support is provided with a backcoat layer containing an alkali salt of a styrene-maleic acid copolymer and a polymeric latex.

3. A heat-sensitive recording paper as in claim 2, wherein the polymeric latex is at least one member selected from the group consisting of styrene-butadiene copolymer latex, carboxy-modified styrene-butadiene copolymer latex, styrene-butadiene-vinyl pyridine terpolymer latex, acrylate ester copolymer latex, modified acrylate ester copolymer latex, styrene copolymer latex, vinyl acetate copolymer latex, vinyl acetate-acrylic acid copolymer latex, vinyl acetate-ethylene copolymer latex, acrylic acid-butadiene copolymer latex, and acrylic acid-styrene-butadiene terpolymer latex.

4. A heat-sensitive recording paper as in claim 2, wherein the amount of the alkali salt of styrene-maleic acid copolymer is from 1.0 to 1,000 wt %, based on the weight of the polymeric latex.

5. A heat-sensitive recording paper as in claim 4, wherein the amount of the alkali salt of styrene-maleic acid copolymer is from 10 to 100 wt %, based on the weight of the polymeric latex.

6. A heat-sensitive recording paper as in claim 2, wherein said backcoat layer contains a pigment.

7. A heat-sensitive reocrding paper as in claim 6, wherein the alkali salt of styrene-maleic acid copolymer is present in the backcoat layer in an amount of from 10 to 200 wt %, based on the weight of the pigment.

8. A heat-sensitive recording paper as in claim 7, wherein the alkali salt of styrene-maleic acid copolymer is present in the backcoat layer in an amount of from 25 to 75 wt %, based on the weight of the pigment.

9. A heat-sensitive recording paper as in claim 1, wherein said alkali salt is a sodium salt or an ammonium salt.

10. A heat-sensitive recording paper as in claim 1, wherein said alkali salt of styrene-maleic acid copolymer has a degree of polymerication of from 500 to 5,000.

11. A heat-sensitive recording paper as in claim 10, wherein said alkali salt of styrene-maleic acid copolymer has a degree of polymerization of from 1,500 to 2,500.

12. A heat-sensitive recording paper as in claim 1, wherein the alkali salt is esterified and the degree of esterification is from 35 to 50%.

13. A heat-sensitive recording paper as in claim 1, wherein said backcoat layer contains a pigment.

14. A heat-sensitive recording paper as in claim 13, wherein the pigment is at least one member selected from the group consisting of zinc oxide, calcium carbonate, barium sulfate, titanium oxide, crystalline silica, amorphous silica, lithopone, talc, pyrophyllite, kaolin, baked kaolin, aluminum hydroxide, urea-formaldehyde resins, and polyethylene.

15. A heat-sensitive recording paper as in claim 13, wherein the alkali salt of styrene-maleic acid copolymer is present in the backcoat layer in an amount of from 10 to 200 wt %, based on the weight of the pigment.

16. A heat-sensitive recording paper as in claim 15, wherein the alkali salt of styrene-maleic acid copolymer is present in the backcoat layer in an amount of from 25 to 75 wt %, based on the weight of the pigment.

17. A heat-sensitive recording paper as in claim 1, wherein the backcoat layer is present in a dry weight amount of from 0.2 to 5.0 $g/m^2$.

18. A heat-sensitive recording paper as in claim 17, wherein the backcoat layer is present in a dry weight amount of from 0.2 to 3.0 $g/m^2$.

19. A heat-sensitive recording paper as in claim 1, wherein the surface of the backcoat layer has a smoothness in the range of from 30 to 500 seconds (based on JIS P8119).

20. A heat-sensitive recording paper as in claim 1, wherein the surface of the backcoat layer has a smoothness in the range of from 80 to 150 seconds (based on JIS P8119).

* * * * *